US006938666B1

(12) United States Patent
Ulriksen et al.

(10) Patent No.: US 6,938,666 B1
(45) Date of Patent: Sep. 6, 2005

(54) SCREENING ARRANGEMENT

(75) Inventors: Ulrik Ulriksen, Skjern (DK); Martin Armand Mortensen, Skjern (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 10/332,699

(22) PCT Filed: Jul. 13, 2000

(86) PCT No.: PCT/DK00/00397

§ 371 (c)(1),
(2), (4) Date: Apr. 10, 2003

(87) PCT Pub. No.: WO02/06621

PCT Pub. Date: Jan. 24, 2002

(51) Int. Cl.[7] ..... A47G 5/02
(52) U.S. Cl. ..... 160/98; 160/31; 160/265
(58) Field of Search ..... 160/98, 242, 265, 160/310, 195, 31; 52/72, 200

(56) References Cited

U.S. PATENT DOCUMENTS

| | | | | |
|---|---|---|---|---|
| 2,517,514 A | * | 8/1950 | Walsh | 160/31 |
| 3,460,602 A | * | 8/1969 | Hugus | 160/265 |
| 4,691,753 A | * | 9/1987 | Baier | 160/32 |
| 5,103,603 A | * | 4/1992 | Verby et al. | 52/72 |
| 5,207,036 A | * | 5/1993 | Sampson et al. | 52/72 |
| 5,287,908 A | * | 2/1994 | Hoffmann et al. | 160/121.1 |
| 5,878,803 A | * | 3/1999 | Kraeutler | 160/271 |
| 6,138,738 A | * | 10/2000 | Moller et al. | 160/98 |
| 2003/0019588 A1 | * | 1/2003 | Schmitz | 160/66 |

FOREIGN PATENT DOCUMENTS

| | | |
|---|---|---|
| DE | 29 06 913 C2 | 9/1980 |
| DE | 34 15 551 A1 | 10/1985 |
| DE | 44 01 056 C1 | 3/1995 |
| DE | 196 00 952 A1 | 7/1997 |
| EP | 0 207 870 A2 | 1/1987 |

* cited by examiner

*Primary Examiner*—Blair M. Johnson
(74) *Attorney, Agent, or Firm*—Merek, Blackmon & Voorhees, LLC

(57) ABSTRACT

The screening arrangement is meant for screening of a window which is built into a roof surface and comprises a flexible screening body with a bottom bar in connection with the free end of the bar. A top casing for the screening arrangement is placed at the top frame or sash member of the window and comprises a reception means, such as a roller. The screening arrangement comprises at least on rotatable connection which permits a displacement of the screening body to a position in which it forms an angle with the roof surface and is positioned within the end wall of the top casing. The reception means is situated essentially in the plane of the screening, the top casing having such a form that it follows the form of the window at the top frame or sash member. The rotatable connection can be provided near at least two sets of spaced hing fittings, where the first fitting part in each of said sets is designed as a mounting fitting to be mounted on the top frame or sash member and has an engagement portion for engagement with a second fitting part in connection with the top casing.

28 Claims, 2 Drawing Sheets

SCREENING ARRANGEMENT

Figure 1:
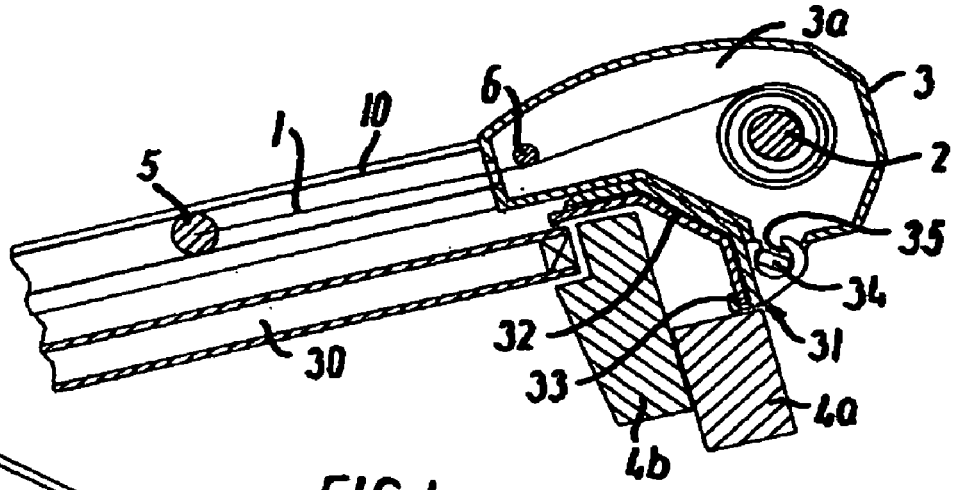

The present invention relates to a screening arrangement for a roof window adapted to be built into a roof surface and having a frame structure and a sash structure extending in parallel to the roof surface, each with top and bottom members and two mutually parallel side members, the screening arrangement comprising a screening body having a first end, a second end and two side edges, a bottom bar connected with said first end of the screening body and extending essentially in parallel said top and bottom members of the frame or sash structure, a top casing extending along the top member of the frame or sash structure and having, in each end, an end wall, which is essentially parallel to said side members of the frame and sash structures, a reception means situated in said top casing and connected with said second end of the screening body, and side guide rails to be mounted essentially in parallel with said side members of the frame and sash structure for accommodation and guidance of ends of the bottom bar and said side edges of the screening body, the screening body being movable between a first end position in which it occupies a rolled-up, pleated or folded position on or at said reception means in the top casing and a second active screening position, in which it extends in a screening plane to said frame or sash structure the screening arrangement including at least one rotatable connection situated within said end walls of the top casing for movement of at least said side guide rails of the screening arrangement with the screening body accommodated therein between said screening plane and a plane forming an angle with the roof surface, about a hinge axis essentially parallel to said top and bottom members of the frame or sash structure.

Such screening arrangements are known in many different forms and comprise e.g. awning blinds, roller blinds and roller shutters, where the screening body in the non-screening position is rolled-up on a reception means in the form of a roller, and pleated blinds and Venetian blinds, where the screening body is pleated and folded, respectively, at a reception means which for these kinds of screening typically comprises wiring and operation devices. In the prior art, such screening arrangements are known, in particular for placement on the outside of the window and in connection with an openable window sash, where it is necessary to tilt at least the screening body in relation to the plane of the roof surface in order to open the window. The rotatable connection can be provided e.g. by a hinge between the top casing and the top frame or sash member of the window, where the hinge connection can be placed at the lower edge of the top casing as shown in DE patent no. 29 06 913, DE patent no. 44 01 056 and EP patent application no. 0 207 870, whereas e.g. DE publication no. 196 00 952 discloses an arrangement where the hinge connection comprises consoles at the end walls of the top casing.

Irrespective of the kind of screening arrangement in question and irrespective of the placement being inside or outside in relation to the window, the design is generally desired to be as compact as possible, both for aesthetic reasons as it is desirable to avoid that the screening arrangement disfigures the appearance of the building, and for practical reasons, such as conditions for building-in. This applies in particular when installing a window in roof surfaces where it is not possible or desirable to modify the roof structure and/or the surrounding roof covering. Furthermore, the screening arrangement is desired not to restrict the view through the window in a non-screening position, i.e. where the screening body is rolled-up, folded or pleated in the top casing.

Therefore, the object of the invention is to improve a screening arrangement of the type mentioned by way of introduction with regard to building-in and appearance.

With this end in view, the screening arrangement according to the invention is characterized in that said reception means is placed essentially in said screening plane and that the top casing is formed to follow the form of the top member of the frame and sash structures.

By its placement essentially in the screening plane the reception means with be positioned in the top casing at a relatively low level in relation to the roof surface. Together with forming of the top casing to follow the form of the top member of the frame and sash structures the arrangement results in a very desirable compact design of the screening arrangement, the dimensions in the elevation, longitudinal as well as width direction being substantially reduced compared to in corresponding arrangements in prior art as disclosed e.g. in DE-A1-29 06 913.

Preferred and advantageous embodiments of the screening arrangement are stated in the dependent claims.

In this context, a particularly compact design of a screening arrangement is obtained by an embodiment, in which as stated in claim 8 the movement of the screening body from said first end position to said second screening position is effected by means of an electric drive motor via a cord arrangement comprising two draw cords guided separately in said side guide rails, each of said cords having one end connected with a winding reel coupled to the drive motor at one of said top or bottom members of the frame or sash structure and another end connected with said bottom bar, said other cord end being spring-biased in a direction opposite to the traction acting on the cord, whereby the winding reel is provided with a smooth abutment surface for the rewound cord, and a cord guidance is provided in connection with the winding reel to assure winding of the cord in a single cord layer in the longitudinal direction of the reel.

By a particularly simple further development of this embodiment, the abutment surface of the winding reel may be lowered in relation to two end guides, the cord being fastened to the reel at one end guide, whereby the cord guidance may comprise a bar element positioned opposite the abutment surface of the reel and faintly tilted in relation to the reel axis such that its distance from the reel axis decreases in the direction from said one end guide towards the second end guide.

As a consequence of the spring bias on the second cord end, the tilted cord guide, the angle of which with the reel axis preferably amounts to 5–25°, e.g. 15°, entails that the cord during its own winding is displaced in the direction from one cord guide at which the cord is fastened to the reel toward the second cord guide.

The spring bias of the second cord end can appropriately be produced by a screw compression spring positioned in the bottom bar and in one end connected with an end plug for the bottom bar and in the second end with the second cord end.

The winding reels for the two cords can either be arranged at the top frame or sash member, and each cord can be led around a cord return element at the bottom frame or sash member for connection of the second cord end with the bottom bar, or as an alternative be positioned at the bottom frame or sash member for a direct connection of the second end of each cord with the bottom bar.

In the following, the invention will be described in more detail by means of examples of embodiments and with reference to the schematic drawing, where FIG. 1 shows a side view partly sectional of a screening arrangement in a first embodiment of the invention, FIG. 2 a view of the screening arrangement shown in FIG. 1 during its mounting, FIG. 3 a view corresponding to FIG. 1 of a second embodiment, FIG. 4 a perspective view of a third embodiment of the invention, and FIG. 5 a detail of the embodiment shown in FIG. 4.

Figure 2:
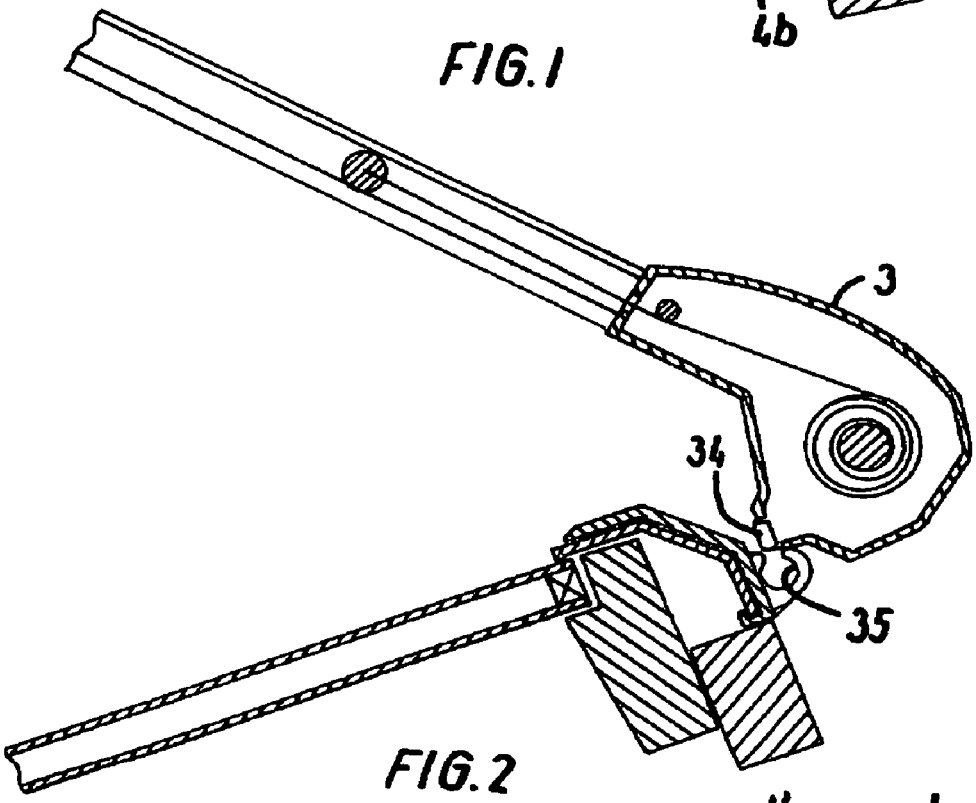

As an embodiment of the screening arrangement according to the invention is in FIGS. 1 and 2 shown an external awning blind with a screening body in the form of an awning cloth 1 which in one end is fastened to a roller 2 constituting a reception means for the screening body and mounted in a top casing 3 at the top frame member 4*a* of the window and a top sash member 4*b* where the window is openable. Furthermore, each frame and sash structure comprises a not-shown bottom bar together with two side members, the sash members together bordering an insulating pane 30. The top casing 3 extends along the top frame and sash members 4*a* and 4*b* of the window and has in each end an end wall, of which in FIGS. 1 and 2 only one end wall 3*a* is seen.

The opposite free end of the awning cloth 1 is connected to a tubular bottom bar 5, between which and the roller 2, the awning cloth 1 in the shown embodiment is led around a guide roller 6 also placed in the top casing 3.

The screening arrangement further comprises a side guide rail which in mounted position is connected to the side members of the sash structure and of which one side guide rail 10 is shown in FIGS. 1 and 2. The side guide rails 10 are meant to accommodate and lead the ends of the bottom bar 5 and the edges of the awning cloth 1.

The top casing 3 of the screening arrangement is rotatably connected to the window structure by means of two mutually spaced sets of hinge fittings where each set comprises a first fitting part in the form of a mounting fitting 31 connected to a top casing 32 for the window, e.g. as shown with a hook 33 and a not-shown screw connection, and a second fitting part in the form of an axle journal 34 in connection with the top casing 3 of the screening arrangement.

The mounting fitting 31 has an engagement portion designed as an essentially keyhole-shaped incision 35 which comprises a narrowed mouth in connection with a circular portion of the incision. As can be seen from FIG. 1, the engagement portion lies in front of the end wall 3*a* and, thus, lies between the end wall 3*a* and the other end wall of the top casing 3. The axle journal 34 has in one direction a first dimension corresponding to the width of the mouth of the incision 35, whereas the axle journal 34 in the direction perpendicular thereto has a second dimension fitting the diameter of the circular portion of the incision 35. In this way, the screening arrangement can easily be mounted on the window by inserting the axle journal 34 in the incision 35, whereas the screening arrangement is kept in the position shown in FIG. 2. When the axle journal 34 has been inserted into the circular portion of the incision 35, the screening arrangement can be turned down past the window and connected to the sash structure in an appropriate manner. When mounted, the screening arrangement can then be moved together with the sash structure, when this is opened in relation to the frame structure.

Figure 3:
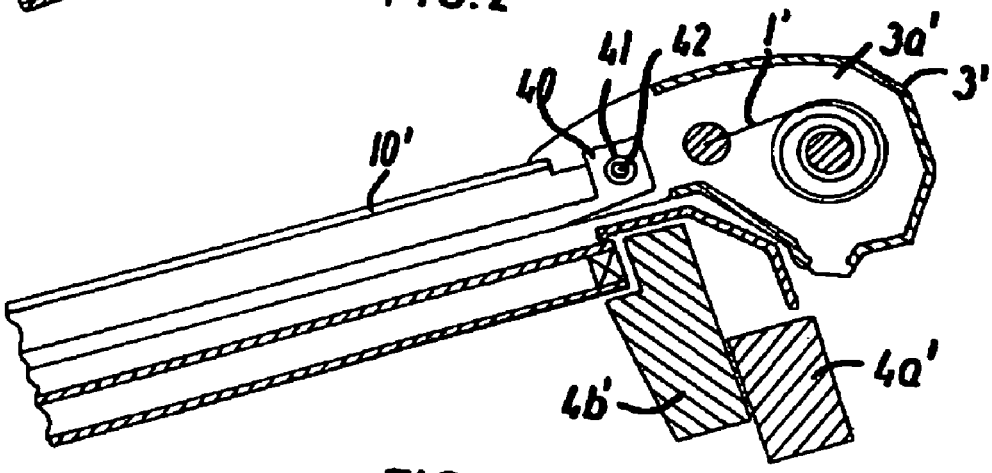
Figure 4:
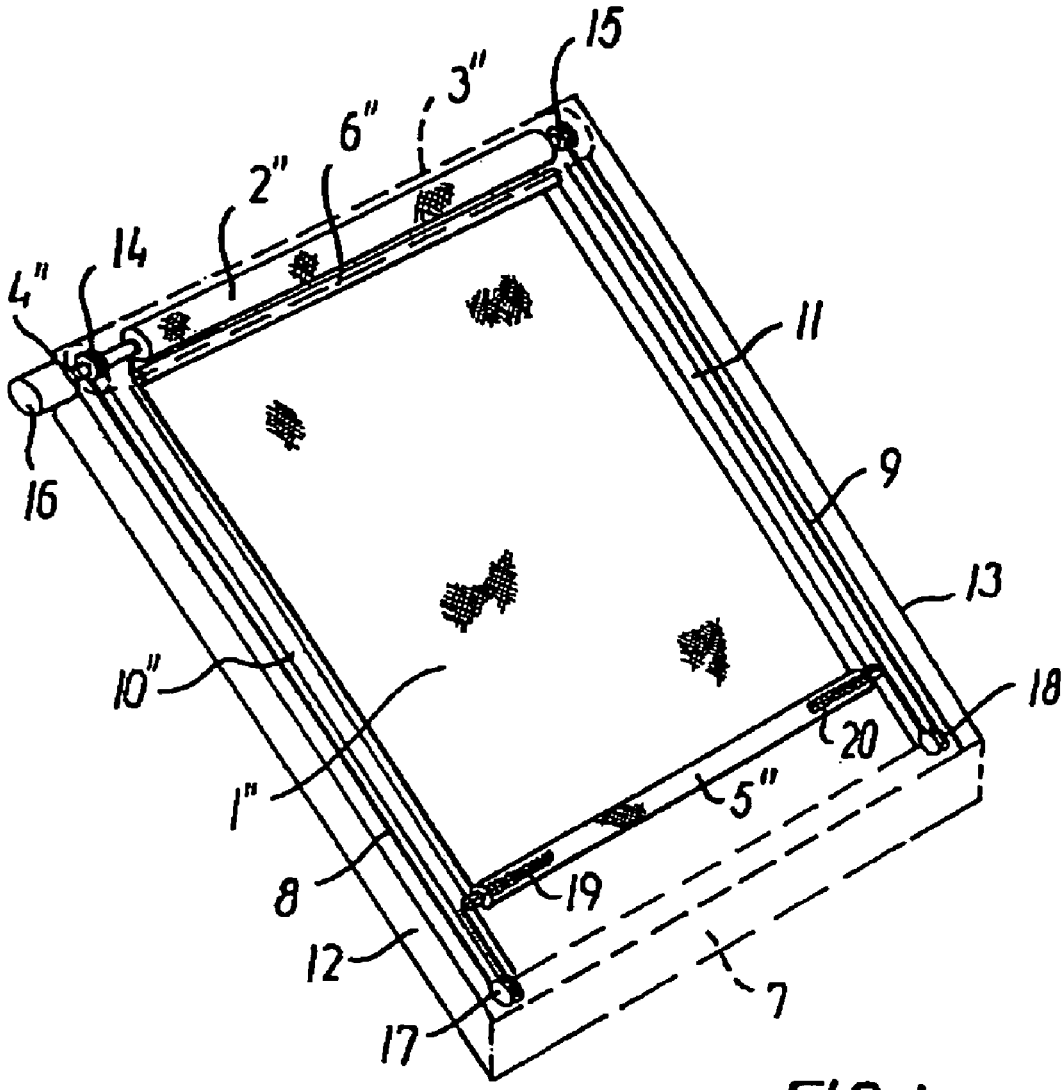

A second embodiment of the screening arrangement according to the invention is shown in FIG. 3 where parts with similar or analogue function in relation to the embodiment in FIGS. 1 and 2 have the same referential number added with '.

The tilting of the screening length, e.g. an awning cloth 1', is provided in this embodiment in that each side guide rail 10' is rotatably connected to the top casing 3' of the screening arrangement, whereas the top casing 3' itself is firmly connected to the top member 4*a*' of the frame structure. The hinge connection comprises an upright flap 40 on the side guide rail 10' with an opening 41 for accommodation of a pin 42 in connection with the top casing 3'. As can be seen from FIG. 3, the upright flap 40 and the pin 42 lie in front of the end wall 3*a*' of the top casing 3'.

In the following, a third embodiment of the screening arrangement according to the invention will be described with reference to FIGS. 4 and 5. This embodiment can be combined with the first or second embodiment in FIGS. 1–2 and 3, respectively. Parts with similar or analogue function in relation to the above embodiments have the same referential number added with ".

For movement of the bottom bar 5" and the connected end of the awning cloth 1" from a first end position in which the bottom bar 5" is positioned at or in the top casing 3" such that the window is not screened by the awning cloth 1", to a second end position in which the bottom bar 5" is positioned at the bottom frame or sash member 7 of the window, the bottom bar 5", is connected to a cord guidance comprising two draw cords 8 and 9 which are led each in their side guide rail 10" and 11, respectively, fastened to the frame or sash side members 12 and 13 of the window which also provide a guide for not-shown end covers or plugs to the tubular bottom bar 5".

Each cord 8 and 9 is in one end fastened to a winding reel 14 and 15, respectively, each of which in the shown design is placed outside its respective end of the roller 2". The winding reels 14 and 15 are coupled to an electric drive unit in the form of an electric motor 16 with an associated transmission such that the displacement of the bottom bar 5 from the first to the second end position is effected by electric operation of a keyboard designed for this purpose, perhaps a remote control.

From the winding reels 14, 15, each cord 8, 9 is through the associated side guide rail 10", 11 led around a cord return element e.g. in the form of a pulley 17, 18 placed at the bottom frame or sash member 7 and into one or another, respectively, end of the tubular bottom bar 51", where the free cord end is connected to one end of a screw compression spring 19, 20, the other end of which is connected to the not-shown end cover or end plug of the bottom bar 5" in the same side.

Figure 5:
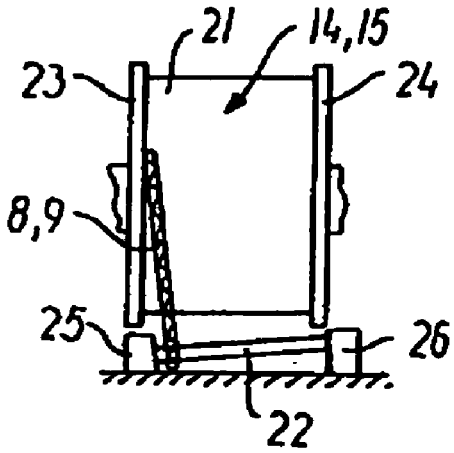

In order to assure the rewinding of each cord 8, 9 on the associated winding reel 14, 15 in a single layer of cord windings with minimal width of the winding reel, each winding reel 14 and 15 is, as shown in FIG. 5, designed with a smooth, plane abutment or rewinding surface 21 for the cord rewinding, and to each winding reel 14, 15, a cord guide 22 is connected to assure the cord winding in a single cord or winding layer in the longitudinal direction for the reel 14, 15.

In the shown embodiment, the abutment or rewinding surface 21 of the winding reel 14, 15 is as shown in FIG. 5 lowered between two end guides 23, 24, and the associated cord 8, 9 is fastened to the reel at one end guide 23, whereas the cord guide 22 is designed as a bar element positioned opposite the abutment or rewinding surface 21 and fixed in the top casing 31" by means of end fittings 25, 26.

The bar element 22 is slightly tilted in relation to the axis of the associated winding reel 14, 15 preferably at an angle of 5–25°, e.g. 15° with the reel axis.

During the rotation of the winding reel 14, 15 for rewinding the associated cord 8, 9, the bottom bar 5" with the shown cord guidance will be displaced from the first towards the second end position. During this displacement, each cord 8 and 9 will as a consequence of the spring load from the screw compression springs 19, 20 be kept tightly extended, and the cord guides 22 will thus automatically entail that the cords 8 and 9 during rewinding are displaced in the longitudinal direction of the associated winding reel 14, 15 from one end guide 23 where the cord 8, 9 is fastened to the reel 14, 15 towards the second end guide 24.

Instead of being placed in the top casing 3, the winding reels 14, 15 can with associated electric drive unit 16 be arranged in an bottom casing at the bottom frame or sash member 7, which can have the advantage that the length of the winding cords 8, 9 can be shortened such that the width of the winding reels 14, 15 can be further reduced.

In an embodiment as shown on the drawing, the movement of the screening body 111 in the opposite direction can be effected by impact from the roller by a constant force, e.g. a spring power, or electrically by means of a separate rewinding motor.

Even though the invention in the above has been described only for an external awning blind as embodiment example, it may also be used in other current forms of external screening arrangement such as roller shutters.

What is claimed is:

1. A screening arrangement for a roof window adapted to be built into a roof surface and having a frame structure and a sash structure extending in parallel to the roof surface, each with top and bottom members and two mutually parallel side members, the screening arrangement comprising a screening body having a first end, a second end and two side edges, a bottom bar connected with said first end of the screening body and adapted to extend substantially parallel to said top and bottom members of the frame structure or the sash structure, a top casing adapted to extend along the top member of the frame structure or the sash structure and having, at each end, an end wall that is adapted to be substantially parallel to said side members of the frame and sash structures, reception means situated in said top casing and connected with said second end of the screening body, and side guide rails adapted to be mounted substantially parallel with said side members of the frame structure or the sash structure for accommodation and guidance of ends of the bottom bar and said side edges of the screening body, the screening body being movable between a first end position in which the screening body occupies a stored position on or at said reception means in the top casing, and a second active screening position, in which the screening body extends in a screening plane, the screening arrangement including at least one rotatable connection situated between said end walls of the top casing, adapted to connect the screening arrangement to the window at a position between said end walls of the top casing, and adapted to move at least said side guide rails of the screening arrangement with the screening body accommodated therein between said screening plane and a plane forming an angle with the roof surface, about a hinge axis substantially parallel to said top and bottom members of the frame structure or the sash structure, characterized in that said reception means is substantially in said screening plane and that the top casing has a form adapted to follow the form of top members of the frame structure and the sash structure.

2. A screening arrangement according to claim 1, characterized in that said rotatable connection is provided by at least two spaced sets of hinge fittings.

3. A screening arrangement according to claim 2, characterized in that a first fitting part in each of said sets is an installation fitting adapted to be mounted on said top member of the frame structure or the sash structure and has an engagement portion for engagement with a second fitting part connected with the top casing.

4. A screening arrangement according to claim 3, characterized in that the engagement portion in the first fitting part has the form of a generally keyhole-shaped incision with a narrowed mouth in connection with a circular portion of the incision, and that the engagement portion in the second fitting part has the form of an axle journal with a generally rectangular cross section which in one direction has a first dimension corresponding to the width of the mouth of the incision in the first fitting part and in the direction perpendicular thereto has a second dimension fitting the diameter of the circular portion of the incision.

5. A screening arrangement according to claim 2, characterized in that the hinge fitting sets are arranged to have the hinge axis situated at the underside of the top casing and adapted to be situated on an outer side of said top member of the frame structure or the sash structure.

6. A screening arrangement according to claim 1, characterized in that the rotatable connection is provided at a hinge connection between each side guide rail and the top casing.

7. A screening arrangement according to claim 6, characterized in that the hinge connection comprises an upright flap at the end of each side guide rail for accommodation of a substantially circular cylindrical pin in connection with the top casing.

8. A screening arrangement according to claim 1, characterized in that the movement of the screening body from said first end position to said second screening position is effected by means of an electric drive motor via a cord arrangement comprising two draw cords guided separately in said side guide rails, each of said cords having one end connected with a winding reel coupled to the drive motor and another end connected with said bottom bar, said other cord end being spring-biased in a direction opposite to the traction acting on the cord, wherein the winding reel is provided with a smooth abutment surface for the rewound cord, and a cord guidance is provided in connection with the winding reel to assure winding of the cord in a single cord layer in the longitudinal direction of the reel.

9. A screening arrangement according to claim 8, characterized in that the abutment surface of the winding reel is lower than two end guides of the winding reel, the cord being fastened to the reel at one end guide, and that the cord guidance comprises a bar element positioned opposite the abutment surface of the reel and faintly tilted in relation to the reel axis such that its distance from the reel axis decreases in the direction from said one end guide towards the second end guide.

10. A screening arrangement according to claim 9, characterized in that the bar element forms an angle of 5–25° with the reel axis.

11. A screening arrangement according to claim 8, characterized in that said spring-bias of the second cord end is provided by a screw compression spring positioned in the bottom bar and connected in one end with an end plug for the bottom bar and in the other end with said second cord end.

12. A screening arrangement according to claim 8, characterized in that the winding reels for the two cords are arranged adjacent to said reception means, and each cord is led around a cord return element at an end of one of said guide rails remote from said reception means, for connection of the second cord end with the bottom bar.

13. A screening arrangement according to claim 8, characterized in that the winding reels for the two cords are positioned at an end of one of said guide rails remote from said reception means, for a direct connection of the second end of each cord with the bottom bar.

14. A screening arrangement according to claim 9, characterized in that the bar element forms an angle of about 15° with the reel axis.

15. In combination, a screening arrangement and a roof window adapted to be built into a roof surface and having a frame structure and a sash structure extending in parallel to the roof surface, each with top and bottom members and two mutually parallel side members, the screening arrangement comprising a screening body having a first end, a second end and two side edges, a bottom bar connected with said first end of the screening body and extending substantially parallel to said top and bottom members of the frame structure or the sash structure, a top casing extending along the top member of the frame structure or the sash structure and having, at each end, an end wall that is substantially parallel to said side members of the frame and sash structures, reception means situated in said top casing and connected with said second end of the screening body, and side guide rails mounted substantially parallel with said side members of the frame structure or the sash structure for accommodation and guidance of ends of the bottom bar and said side edges of the screening body, the screening body being movable between a first end position in which the screening body occupies a stored position on or at said reception means in the top casing, and a second active screening position, in which the screening body extends in a screening plane, the screening arrangement including at least one rotatable connection situated between said end walls of the top casing, and connecting the screening arrangement to the window at a position between said end walls of the top casing, for movement of at least said side guide rails of the screening arrangement with the screening body accommodated therein between said screening plane and a plane forming an angle with the roof surface, about a hinge axis substantially parallel to said top and bottom members of the frame structure or the sash structure, characterized in that said reception means is substantially in said screening plane and that the top casing is formed to follow the form of the top members of the frame structure and the sash structure.

16. A screening arrangement according to claim 15, characterized in that said rotatable connection is provided by at least two spaced sets of hinge fittings.

17. A screening arrangement according to claim 16, characterized in that a first fitting part in each of said sets is an installation fitting mounted on said top member of the frame structure or the sash structure and has an engagement portion for engagement with a second fitting part connected with the top casing.

18. A screening arrangement according to claim 17, characterized in that the engagement portion in the first fitting part has the form of a generally keyhole-shaped incision with a narrowed mouth in connection with a circular portion of the incision, and that the engagement portion in the second fitting part has the form of an axle journal with a generally rectangular cross section which in one direction has a first dimension corresponding to the width of the mouth of the incision in the first fitting part and in the direction perpendicular thereto has a second dimension fitting the diameter of the circular portion of the incision.

19. A screening arrangement according to claim 16, characterized in that the hinge fitting sets are arranged to have the hinge axis situated at the underside of the top casing and on an outer side of said top member of the frame structure or the sash structure.

20. A screening arrangement according to claim 15, characterized in that the rotatable connection is provided at a hinge connection between each side guide rail and the top casing.

21. A screening arrangement according to claim 20, characterized in that the hinge connection comprises an upright flap at the end of each side guide rail for accommodation of a substantially circular cylindrical pin in connection with the top casing.

22. A screening arrangement according to claim 15, characterized in that the movement of the screening body from said first end position to said second screening position is effected by means of an electric drive motor via a cord arrangement comprising two draw cords guided separately in said side guide rails, each of said cords having one end connected with a winding reel coupled to the drive motor at one of said top or bottom members of the frame structure or the sash structure and another end connected with said bottom bar, said other cord end being spring-biassed in a direction opposite to the traction acting on the cord, wherein the winding reel is provided with a smooth abutment surface for the rewound cord, and a cord guidance is provided in connection with the winding reel to assure winding of the cord in a single cord layer in the longitudinal direction of the reel.

23. A screening arrangement according to claim 22, characterized in that the abutment surface of the winding reel is lower than two end guides of the winding reel, the cord being fastened to the reel at one end guide, and that the cord guidance comprises a bar element positioned opposite the abutment surface of the reel and faintly tilted in relation to the reel axis such that its distance from the reel axis decreases in the direction from said one end guide towards the second end guide.

24. A screening arrangement according to claim 23, characterized in that the bar element forms an angle of 5–25° with the reel axis.

25. A screening arrangement according to claim 22, characterized in that said spring-bias of the second cord end is provided by a screw compression spring positioned in the bottom bar and connected in one end with an end plug for the bottom bar and in the other end with said second cord end.

26. A screening arrangement according to claim 22, characterized in that the winding reels for the two cords are arranged at the top frame member or top sash member, and each cord is led around a cord return element at the bottom frame member or bottom sash member for connection of the second cord end with the bottom bar.

27. A screening arrangement according to claim 22, characterized in that the winding reels for the two cords are positioned at the bottom frame member or bottom sash member for a direct connection of the second end of each cord with the bottom bar.

28. A screening arrangement according to claim 23, characterized in that the bar element forms an angle of about 15° with the reel axis.

* * * * *